US010534281B2

(12) United States Patent
Shimizu et al.

(10) Patent No.: US 10,534,281 B2
(45) Date of Patent: Jan. 14, 2020

(54) DISCHARGE MEMBER, CHARGE ELIMINATING DEVICE INCLUDING THE SAME, AND IMAGE FORMING APPARATUS

(71) Applicant: KYOCERA Document Solutions Inc., Osaka (JP)

(72) Inventors: Tamotsu Shimizu, Osaka (JP); Hiroka Itani, Osaka (JP); Kenichi Tamaki, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 16/182,087

(22) Filed: Nov. 6, 2018

(65) Prior Publication Data

US 2019/0072870 A1 Mar. 7, 2019

Related U.S. Application Data

(62) Division of application No. 15/460,736, filed on Mar. 16, 2017, now abandoned.

(30) Foreign Application Priority Data

Mar. 18, 2016 (JP) ..... 2016-055860

(51) Int. Cl.
*G03G 15/02* (2006.01)
*G03G 21/06* (2006.01)
*D02G 3/12* (2006.01)

(52) U.S. Cl.
CPC ..... *G03G 15/0216* (2013.01); *D02G 3/12* (2013.01); *G03G 21/06* (2013.01)

(58) Field of Classification Search
CPC ..... G03G 21/06; G03G 15/0275
(Continued)

(56) References Cited

U.S. PATENT DOCUMENTS 3,706,108 A 12/1972 Taylor ..... 15/1.51
4,555,171 A 11/1985 Clouthier et al. ..... 355/3
(Continued)

FOREIGN PATENT DOCUMENTS

JP 03-249775 A 11/1991
JP 2003-13944 A 1/2003
JP 2007-292905 A 11/2007

OTHER PUBLICATIONS

Extended European Search Report dated Aug. 11, 2017, issued to European Application No. 17161605.5-1568.

*Primary Examiner* — Walter L Lindsay, Jr.
*Assistant Examiner* — Arlene Heredia
(74) *Attorney, Agent, or Firm* — Stein IP, LLC

(57) ABSTRACT

An image forming apparatus has an image carrier, an electrifying member, and a charge eliminating device, and eliminates remaining charge on the surface of the image carrier by the charge eliminating device. The charge eliminating device includes a discharge member. The discharge member includes an electro conductive knit fabric knitted in a cylindrical shape using twisted yarn made of twisted metal fibers and a support member having a cylindrical shape and inserted in the electro conductive knit fabric, and is disposed to face the image carrier in a noncontact manner. A magnet member is disposed inside the image carrier within a charge elimination nip width between two tangential lines of an outer circumference surface of the discharge member, the two tangential lines being parallel to a straight line passing through a rotation center of the image carrier and a center axis of the discharge member.

18 Claims, 8 Drawing Sheets

(58) Field of Classification Search
USPC ..... 399/169
See application file for complete search history.

(56) References Cited

U.S. PATENT DOCUMENTS

| | | | | |
|---|---|---|---|---|
| 4,761,709 | A | 8/1988 | Ewing | 361/225 |
| 5,486,906 | A | 1/1996 | Tsuneeda | 361/225 |
| 6,990,309 | B2 | 1/2006 | Kayahara | 99/302 |
| 9,983,499 | B2 | 5/2018 | Tamaki et al. | 15/241 |
| 2006/0088325 | A1* | 4/2006 | Suzuki | G03G 15/0258 399/44 |
| 2007/0092298 | A1 | 4/2007 | Kamoshida | 399/168 |
| 2011/0103837 | A1 | 5/2011 | Toyoda | 399/174 |

* cited by examiner

DISCHARGE MEMBER, CHARGE ELIMINATING DEVICE INCLUDING THE SAME, AND IMAGE FORMING APPARATUS

INCORPORATION BY REFERENCE

This application is a divisional of U.S. application Ser. No. 15/460,736, filed Mar. 16, 2017, which claims the benefit of priority from the corresponding Japanese Patent Application No. 2016-55860, filed Mar. 18, 2016, the entire contents of which are hereby incorporated by reference.

BACKGROUND

The present disclosure relates to an image forming apparatus such as a copier, a printer, a facsimile machine, or a multifunction peripheral thereof, which utilizes an electrophotographic process. More particularly, the present disclosure relates to an image forming apparatus provided with a charge eliminating device that eliminates remaining charge on the surface of a photosensitive member through electrostatic discharge to the photosensitive member by use of a discharge member.

In an image forming apparatus using the electrophotographic process, remaining charge after transferring a toner image on a photosensitive drum (image carrier) may cause a memory image due to potential unevenness in next image formation. Therefore, before performing an electrification step, the remaining charge on the photosensitive drum is eliminated by the charge eliminating device, and then the photosensitive drum is electrostatically charged again. Thus, the surface of the photosensitive drum is uniformly charged so that occurrence of a memory image can be prevented. As a method for eliminating remaining charge, an optical charge elimination method is usually adopted, in which charge elimination is performed by optical illumination.

However, when repeating charge elimination by the optical charge elimination method, photo carriers generated inside a photosensitive layer may partially remain or be accumulated. In this case, the accumulation of photo carriers causes a malfunction that potential at the surface of the photosensitive drum is lowered. Therefore, a charge elimination method other than the optical charge elimination method is desired.

As a charge elimination method other than the optical charge elimination method, there is proposed a noncontact charge elimination method utilizing a self-discharge phenomenon. In the noncontact charge elimination method, the self-discharge phenomenon from protruding parts of bumps and dips of the discharge member to electrified charge of a target of charge elimination (member to be discharged) is utilized for eliminating remaining charge on the opposed member. For example, there is known an image forming apparatus in which an electro conductive portion including textile fabric made of electro conductive yarn is disposed to face a recording medium on a conveying path between a transfer device and a fixing device, and hence charge of the recording medium after transferring by the transfer device is eliminated in a noncontact manner.

Using this noncontact charge elimination method, remaining charge on the surface of the photosensitive drum is eliminated, so as to avoid remaining of photo carriers inside the photosensitive layer, which is caused in the optical charge elimination method. Thus, the surface potential of the photosensitive drum can be prevented from being lowered. In addition, because the charge eliminating roller does not contact with the photosensitive drum, it is possible to prevent damage to the surface of the photosensitive drum from the charge eliminating roller, abrasion of the photosensitive layer, or contamination of the charge eliminating roller due to toner or toner external additive adhered to the surface of the photosensitive drum. Thus, stable charge elimination effect can be obtained for a long period of time.

SUMMARY

An image forming apparatus according to an aspect of the present disclosure includes an image carrier, an electrifying member, and a charge eliminating device, and eliminates remaining charge on the surface of the image carrier by the charge eliminating device. The image carrier has a surface on which a photosensitive layer is formed. The electrifying member electrifies the photosensitive layer on the surface of the image carrier. The charge eliminating device includes a discharge member, and generates a discharge between the discharge member and the image carrier to eliminate electric charge on the surface of the image carrier. The discharge member includes an electro conductive knit fabric knitted in a cylindrical shape using twisted yarn made of twisted metal fibers and a support member having a cylindrical shape and inserted in the electro conductive knit fabric, and is disposed to face the image carrier in a noncontact manner, in a state where the electro conductive knit fabric is grounded or a voltage is applied to the electro conductive knit fabric. A magnet member is disposed inside the image carrier within a charge elimination nip width between two tangential lines of an outer circumference surface of the discharge member, the two tangential lines being parallel to a straight line passing through a rotation center of the image carrier and a center axis of the discharge member.

Further features and advantages of the present disclosure will become apparent from the description of embodiments given below.

DETAILED DESCRIPTION

Figure 1:
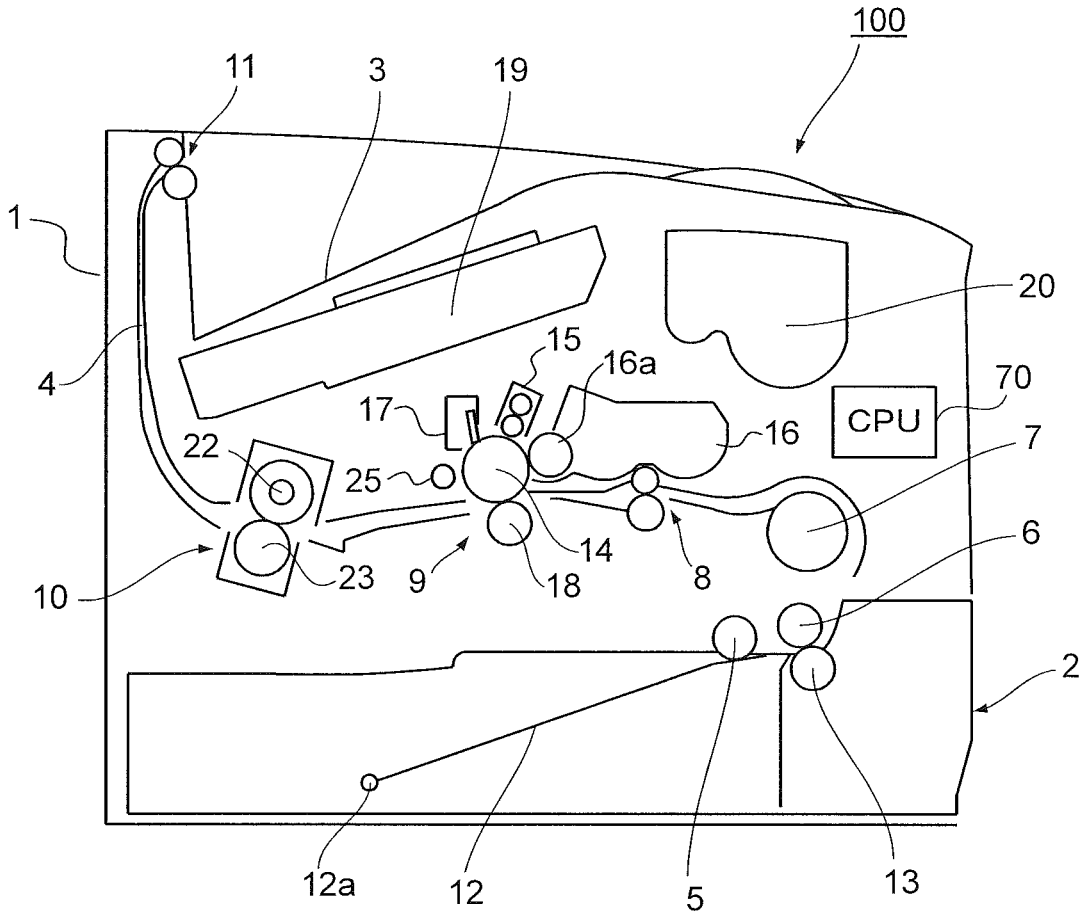
FIG. 1 is a schematic diagram illustrating an overall structure of an image forming apparatus according to a first embodiment of the present disclosure.

Hereinafter, embodiments of the present disclosure are described with reference to the drawings. FIG. 1 is a schematic diagram illustrating an overall structure of an image forming apparatus 100 according to a first embodiment of the present disclosure, in which the right side of the illustration corresponds to a front side of the image forming apparatus 100. As illustrated in FIG. 1, the image forming apparatus 100 (a monochrome printer in this description) includes a sheet feed cassette 2 disposed in a lower part of an apparatus main body 1 so as to store paper sheets. Above this sheet feed cassette 2, there is formed a sheet conveying path 4, which extends substantially horizontally from the front to the rear of the apparatus main body 1 and further extends upward to reach a sheet discharging portion 3 formed on an upper surface of the apparatus main body 1. Along this sheet conveying path 4, there are disposed, in order from the upstream side, a pickup roller 5, a feed roller 6, an intermediate conveying roller 7, a registration roller pair 8, an image forming portion 9, a fixing device 10, and a discharge roller pair 11. Further, in the image forming apparatus 100, there is disposed a control unit (CPU) 70 for controlling operations of the rollers, the image forming portion 9, the fixing device 10, and the like described above.

The sheet feed cassette 2 is equipped with a sheet stack tray 12, which is supported by a pivoting fulcrum 12*a* disposed at an rear end in a sheet conveying direction, in a turnable manner with respect to the sheet feed cassette 2, so that the paper sheets (recording media) stacked on the sheet stack tray 12 are pressed to the pickup roller 5. In addition, a retard roller 13 is disposed in press-contact with the feed roller 6 on the front side of the sheet feed cassette 2. If a plurality of paper sheets are simultaneously fed by the pickup roller 5, the feed roller 6 and the retard roller 13 separates the paper sheets so that only the top sheet is conveyed.

Further, the conveyed direction of the paper sheet separated by the feed roller 6 and the retard roller 13 is changed to the direction toward the rear of the apparatus by the intermediate conveying roller 7, and the paper sheet is conveyed to the registration roller pair 8. Then, the paper sheet is fed to the image forming portion 9 at a timing adjusted by the registration roller pair 8.

The image forming portion 9 forms a predetermined toner image on the paper sheet by the electrophotographic process. The image forming portion 9 includes a photosensitive drum 14 as an image carrier pivoted in a rotatable manner in clockwise direction in FIG. 1, an electrifying device 15, a developing device 16, a charge eliminating roller 25, and a cleaning device 17, which are arranged around the photosensitive drum 14, a transfer roller 18 disposed to face the photosensitive drum 14 via the sheet conveying path 4, and a laser scanning unit (LSU) 19 disposed above the photosensitive drum 14. Above the developing device 16, there is disposed a toner container 20 for replenishing toner to the developing device 16.

In this embodiment, the photosensitive drum 14 is an organic photoconductor (OPC), which is constituted of an organic photosensitive layer formed on an electro conductive base body (cylindrical body) made of aluminum or the like.

The electrifying device 15 includes an electrifying roller 41 (see FIG. 2) that contacts with the photosensitive drum 14 so as to apply an electrification bias to the drum surface, and an electrifying roller cleaning brush for cleaning the electrifying roller 41, which are disposed in a housing. The electrifying roller 41 is made of electro conductive rubber and is disposed to contact with the photosensitive drum 14.

The developing device 16 supplies toner by a developing roller 16*a* to an electrostatic latent image formed on the photosensitive drum 14. Supply of the toner to the developing device 16 is performed by the toner container 20. Note that, in this description, one-component developer containing only magnetic toner component (hereinafter also referred simply to as toner) is stored in the developing device 16.

The cleaning device 17 includes a cleaning blade 47 (see FIG. 2) and a toner collecting roller (not shown). The cleaning blade 47 is a blade made of polyurethane rubber having a JIS hardness of 78 degrees, for example, and is mounted at a predetermined angle with respect to a tangential direction of the photosensitive drum 14 at a contact point thereof. Material, hardness, and size of the cleaning blade 47, bite amount and contact pressure thereof to the photosensitive drum 14, and the like are appropriately set in accordance with specification of the photosensitive drum 14. Note that the JIS hardness means hardness defined by Japanese Industrial Standards (JIS).

The transfer roller 18 transfers the toner image formed on the surface of the photosensitive drum 14 to the paper sheet conveyed along the sheet conveying path 4, without disturbance. The transfer roller 18 is connected to a transfer bias power supply and a bias control circuit (both not shown) for applying a transfer bias having a polarity opposite to the toner.

When receiving image data from a host apparatus such as a personal computer, the electrifying device 15 first electrifies uniformly the surface of the photosensitive drum 14. Next, the electrostatic latent image based on input image data is formed on the photosensitive drum 14 by a laser beam from the laser scanning unit (LSU) 19. Further, toner is adhered to the electrostatic latent image by the developing device 16, so that the toner image is formed on the surface of the photosensitive drum 14. The toner image formed on the surface of the photosensitive drum 14 is transferred by the transfer roller 18 onto the paper sheet supplied to a nip portion (transfer position) between the photosensitive drum 14 and the transfer roller 18.

The paper sheet with the transferred toner image is separated from the photosensitive drum 14 and is conveyed to the fixing device 10. This fixing device 10 is disposed on the downstream side of the image forming portion 9 in the sheet conveying direction. In the image forming portion 9, the paper sheet with the transferred toner image is heated and pressed by a heating roller 22 provided to the fixing device 10 and a pressure roller 23 in press-contact with the heating roller 22, so that the transferred toner image on the paper sheet is fixed. Then, the paper sheet after the image formation in the image forming portion 9 and the fixing device 10 is discharged by the discharge roller pair 11 to the sheet discharging portion 3.

After the transfer, residual toner on the surface of the photosensitive drum 14 is removed by the cleaning device 17, and remaining charge on the surface of the photosensitive drum 14 is eliminated by the charge eliminating roller 25. Then, the photosensitive drum 14 is electrified again by the electrifying device 15, so that the image formation is performed in the same manner.

Figure 2:
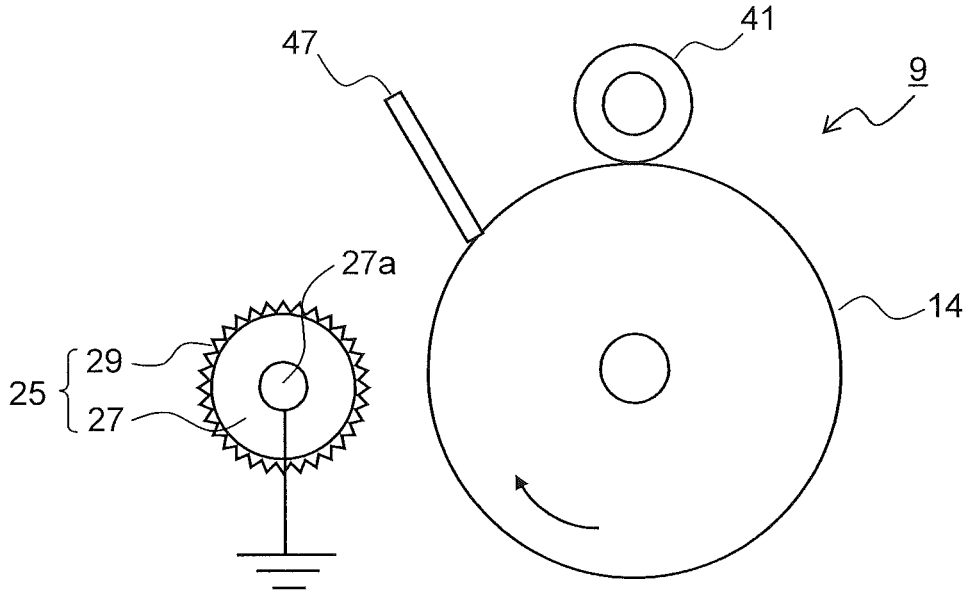
FIG. 2 is a partial enlarged view of an image forming portion of the image forming apparatus according to the first embodiment.

FIG. 2 is a partial enlarged view of the image forming portion 9 and its periphery of the image forming apparatus 100 of the first embodiment. Note that, for convenience of description, FIG. 2 illustrates only the photosensitive drum 14, the electrifying roller 41, the cleaning blade 47, and the charge eliminating roller 25, while illustration of the developing device 16, the transfer roller 18, and the like is omitted.

When the photosensitive drum 14 rotates in clockwise direction in FIG. 2, the electrifying roller 41 contacting with the surface of the photosensitive drum 14 rotates to follow the same in counterclockwise direction in FIG. 2. In this case, a predetermined voltage is applied to the electrifying roller 41 so that the surface of the photosensitive drum 14 is uniformly electrified. In addition, along with the rotation of the electrifying roller 41, the electrifying roller cleaning brush in contact with the electrifying roller 41 rotates to follow the same in clockwise direction in FIG. 2, so as to remove foreign matters adhered to the surface of the electrifying roller 41.

On the upstream side of the electrifying roller 41 in the rotation direction of the photosensitive drum 14, the cleaning blade 47 is secured so as to contact with the surface of the photosensitive drum 14.

On the upstream side of the cleaning blade 47 in the rotation direction of the photosensitive drum 14, the charge eliminating roller 25 is disposed to face the surface of the photosensitive drum 14 in a noncontact manner. The charge eliminating roller 25 includes a cylindrical support member 27 and an electro conductive knit fabric 29 mounted on the outer circumference surface of the support member 27.

Note that the charge eliminating roller 25 is disposed on the upstream side of the cleaning blade 47 in the rotation direction of the photosensitive drum 14 in FIG. 2, but the charge eliminating roller 25 may be disposed on the downstream side of the cleaning blade 47 but on the upstream side of the electrifying roller 41.

Figure 3:
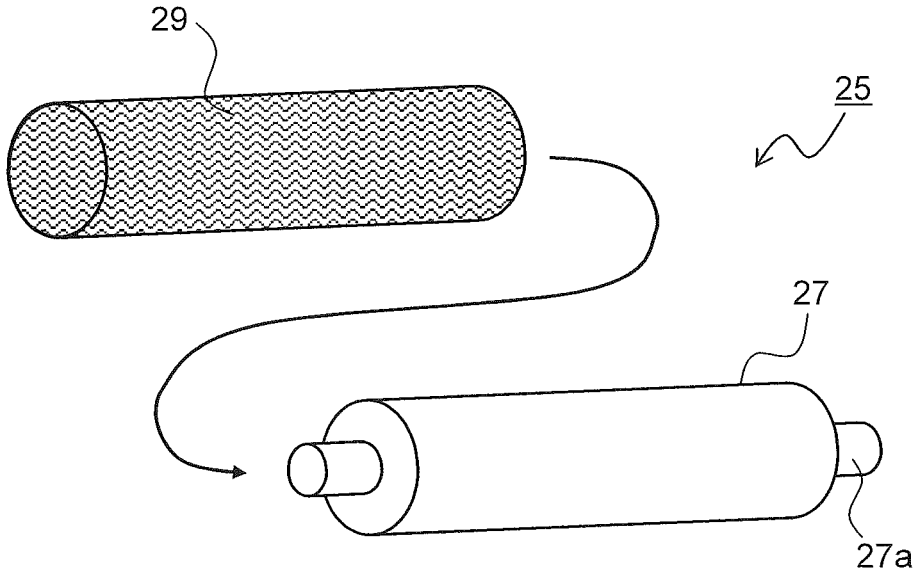
FIG. 3 is an exploded perspective view of a charge eliminating roller used in the image forming apparatus of the first embodiment.

FIG. 3 is an exploded perspective view of the charge eliminating roller 25 used in the image forming apparatus 100 of the first embodiment. The support member 27 is made of metal, and support shafts 27*a* are formed on both ends thereof in the longitudinal direction. As illustrated in FIG. 2, the support shaft 27*a* is connected to the ground. The electro conductive knit fabric 29 is fabric knitted in a cylindrical shape using twisted yarn made of twisted metal fibers. As the metal fibers, stainless steel fibers are used, for example.

Note that, in this specification, the "knit fabric" is formed one by one stitch using one twisted yarn to make knots, and it is clearly different from "textile fabric" that is formed "one by one step" to have a structure in which multiple warp yarns and woof yarns cross each other.

The electro conductive knit fabric 29 has elasticity, and therefore the electro conductive knit fabric 29 is formed to have an inner diameter smaller than the outer diameter of the support member 27. When assembling the charge eliminating roller 25, as illustrated in FIG. 3, the support member 27 is inserted in the inside of the electro conductive knit fabric 29 while stretching the electro conductive knit fabric 29 in the radial direction, so that the electro conductive knit fabric 29 is mounted on the outer circumference surface of the support member 27. A restoring force (contraction force) of the electro conductive knit fabric 29 enables it to be held on the outer circumference surface of the support member 27.

Figure 4:
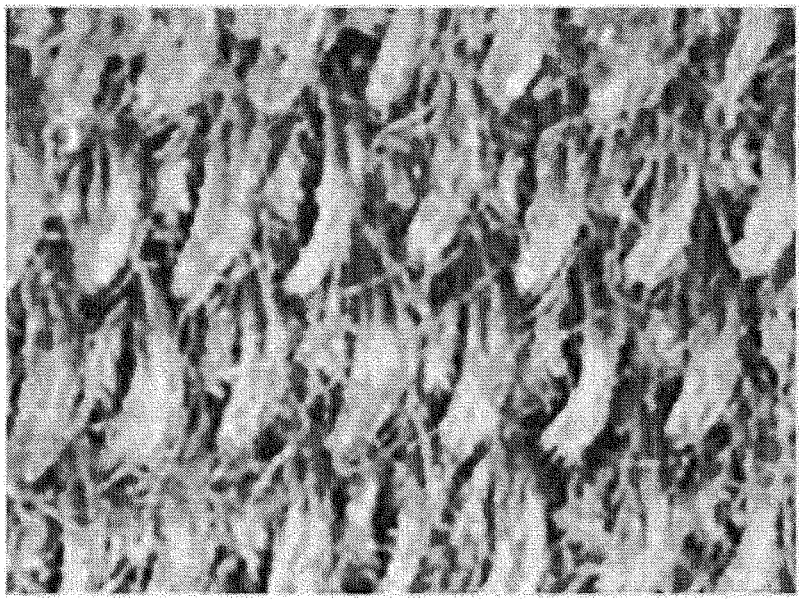
FIG. 4 is an enlarged photograph of a surface of an electro conductive knit fabric.

FIG. 4 is an enlarged photograph of the surface of the electro conductive knit fabric 29. As illustrated in FIG. 4, many metal fibers protrude from the surface of the electro conductive knit fabric 29. Corona discharge is generated between the metal fiber and the surface of the photosensitive drum 14 so that ions having a polarity opposite to the surface charge of the photosensitive drum 14 are released from the metal fiber, and hence remaining charge on the surface of the photosensitive drum 14 is eliminated.

The charge eliminating roller 25 used for the image forming apparatus 100 of this embodiment eliminates remaining charge on the surface of the photosensitive drum 14 using the a self-discharge phenomenon with the photosensitive drum 14, and hence a phenomenon that photo carriers remains inside the photosensitive layer, which occurs in an optical charge elimination method, does not occur. Therefore, it is possible to prevent a malfunction that a surface potential of the photosensitive drum 14 is lowered due to the remaining photo carriers.

In addition, the charge eliminating roller 25 can perform the charge elimination without contacting with the photosensitive drum 14, and hence it is possible to prevent damage to the surface of the photosensitive drum 14, abrasion of the photosensitive layer, or contamination of the charge eliminating roller 25 by toner or toner external additive. Therefore, it is possible to maintain a stable charge elimination effect for a long period of time.

The electro conductive knit fabric 29 used for the charge eliminating roller 25 is formed by knitting the twisted yarn made of twisted metal fibers and therefore has a much larger specific surface area than a textile fabric made of metal fibers, for example. As a result, discharge points are increased so that corona discharge can be efficiently generated, and hence highly efficient charge elimination can be performed. In addition, as fineness of the metal fibers used for the twisted yarn is lower (fibers is thinner), the discharge points are increased, but too thin fibers causes a decrease in durability of the charge eliminating roller 25. It is preferred to use the metal fibers having a diameter of 8 μm or more to 20 μm or less.

Further, elasticity of the electro conductive knit fabric 29 is used so that the electro conductive knit fabric 29 can be secured to the support member 27 without using adhesive or the like. In this case, it is preferred to make a rough outer circumference surface of the support member 27 so that holding performance of the electro conductive knit fabric 29 can be further enhanced.

Figure 5:
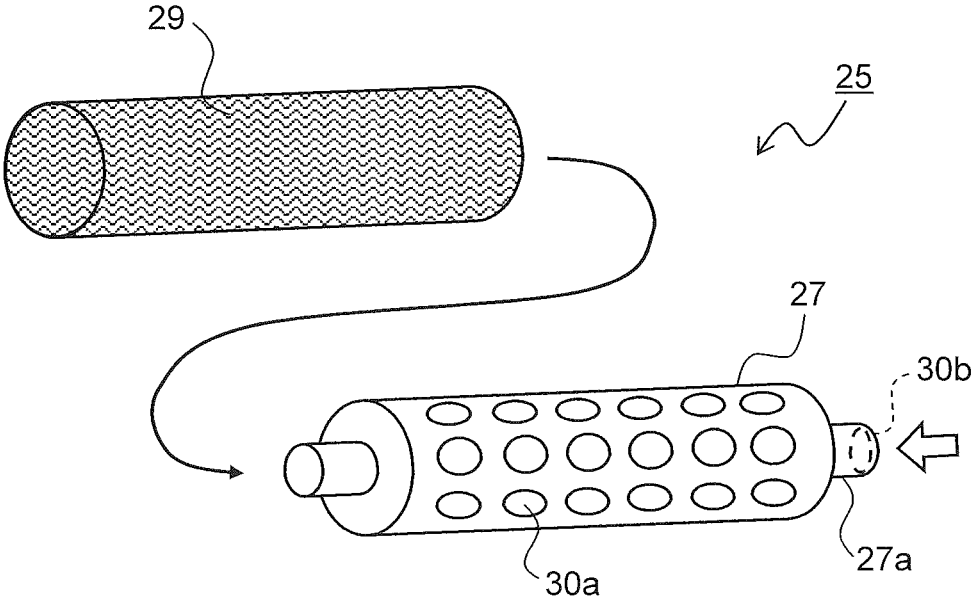
FIG. 5 is an exploded perspective view illustrating a variation of the charge eliminating roller used in the image forming apparatus of the first embodiment.

FIG. 5 is an exploded perspective view illustrating a variation of the charge eliminating roller 25 used for the image forming apparatus 100 of the first embodiment. In the variation illustrated in FIG. 5, the support member 27 is made to have a hollow shape, and many through holes 30*a* are formed in the outer circumference surface. Further, at least one end of the support shafts 27*a* (the support shaft 27*a* on the right side in FIG. 5) and the inside of the support member 27 are communicated to each other so that an air introduction hole 30*b* is formed, and thus air flow is sent from the support shaft 27*a* to the inside of the support member 27.

The air flow sent to the inside of the support member 27 is blown through the through hole 30*a* to the electro conductive knit fabric 29 mounted on the outer circumference surface of the support member 27 and flows through gaps of the electro conductive knit fabric 29 so as to be discharged externally. In this case, dust remaining in the gaps of the electro conductive knit fabric 29 is removed by the air flow, and hence it is possible to suppress deterioration of the charge elimination performance due to contamination of the electro conductive knit fabric 29. This variation has a structure using a feature of the electro conductive knit fabric 29 being superior in air permeability, and the same effect cannot be expected in a textile fabric, a felt, a nonwoven fabric, or the like having low air permeability.

Figure 6:
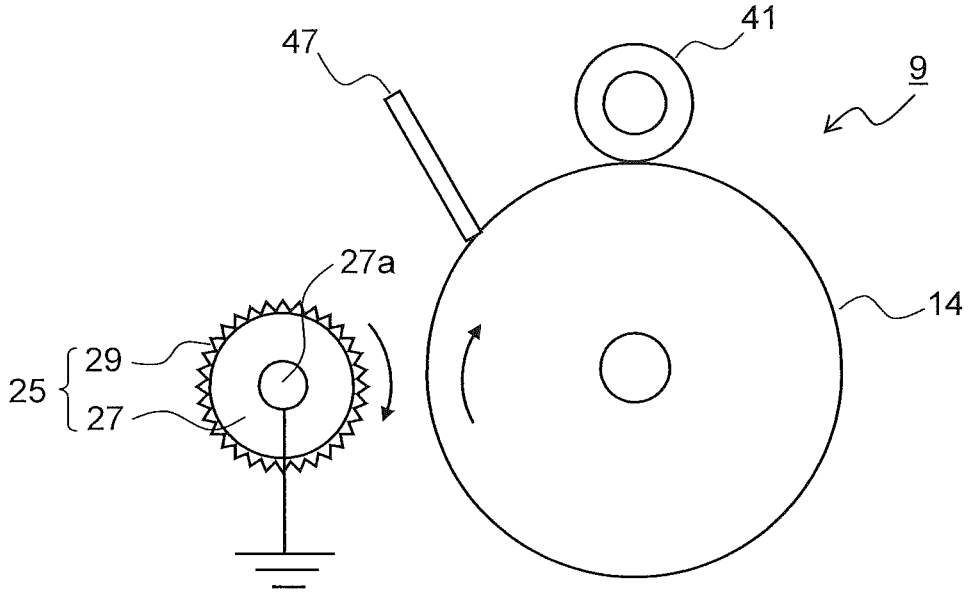
FIG. 6 is a partial enlarged view of the image forming portion and its periphery of the image forming apparatus according to a second embodiment of the present disclosure.

FIG. 6 is a partial enlarged view of the image forming portion 9 and its periphery of the image forming apparatus 100 according to a second embodiment of the present disclosure. Note that, similarly to FIG. 2, FIGS. 6 to 13 also illustrate only the photosensitive drum 14, the electrifying roller 41, the cleaning blade 47, and the charge eliminating roller 25.

In this embodiment, the support shafts 27*a* of the support member 27 constituting the charge eliminating roller 25 are supported in a rotatable manner, and a rotation driving force can be input to one of the support shafts 27*a*. In this way, the charge eliminating roller 25 rotates in an opposite direction (counter direction) to the photosensitive drum 14 in a surface facing the photosensitive drum 14.

Because the charge eliminating roller 25 rotates in the opposite direction to the photosensitive drum 14, the discharge points of the electro conductive knit fabric 29 passing the part facing the photosensitive drum 14 is increased. As a result, in comparison with the case where the charge eliminating roller 25 is stopped, charge elimination efficiency is increased. Note that if the process speed of the image forming apparatus 100 (linear speed of the photosensitive drum 14) is high, a linear speed ratio (rotational frequency) of the charge eliminating roller 25 with respect to the photosensitive drum 14 is increased, so that a circumferential direction length of the electro conductive knit fabric 29 passing through the part facing the photosensitive drum 14 is increased. In this way, the discharge points are further increased so that the charge elimination efficiency can be improved more.

Figure 7:
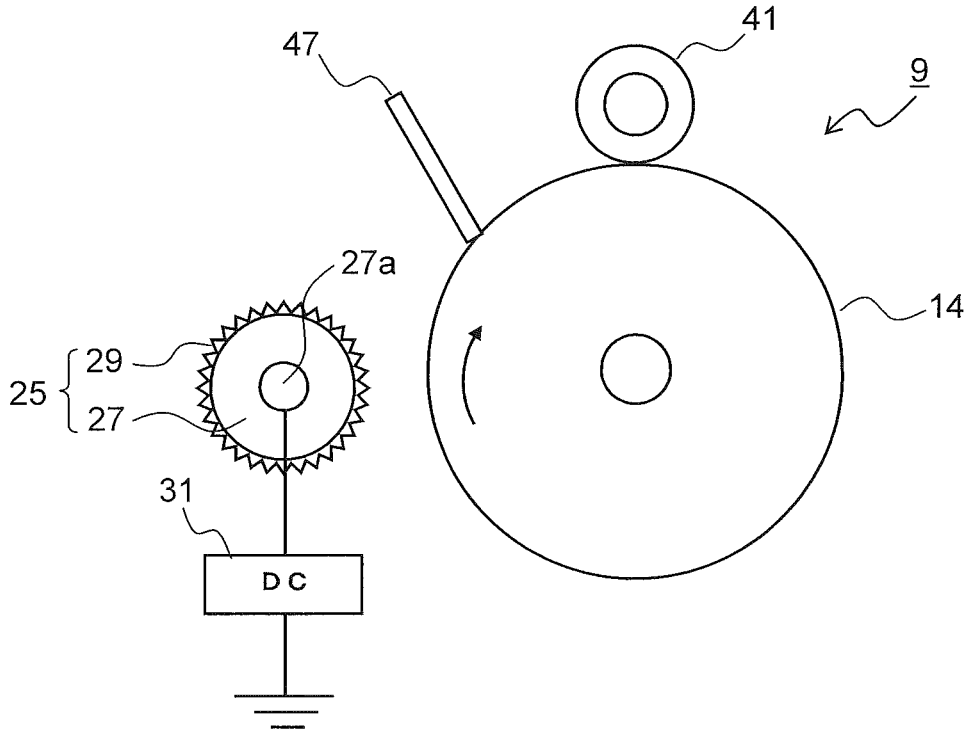
FIG. 7 is a partial enlarged view of the image forming portion and its periphery of the image forming apparatus according to a third embodiment of the present disclosure.

FIG. 7 is a partial enlarged view of the image forming portion 9 and its periphery of the image forming apparatus 100 according to a third embodiment of the present disclosure. In this embodiment, a DC power supply 31 is connected to the support shaft 27*a* of the support member 27 constituting the charge eliminating roller 25, so that a DC voltage can be applied to the charge eliminating roller 25.

Because the charge eliminating roller 25 is applied with the DC voltage having the opposite polarity (negative polarity in this description) to the surface potential of the photosensitive drum 14 (positive polarity in this description), remaining charge on the surface of the photosensitive drum 14 can be eliminated more effectively.

Note that the same effect can be obtained by applying an AC voltage to the charge eliminating roller 25, but there may occur a problem of resonant frequency with the AC voltage applied to the developing roller 16*a* of the developing device 16 (see FIG. 1). Therefore it is preferred to apply the DC voltage. In addition, by changing the DC voltage applied to the charge eliminating roller 25, the charge elimination effect of the remaining charge on the surface of the photosensitive drum 14 can be adjusted.

Figure 8:
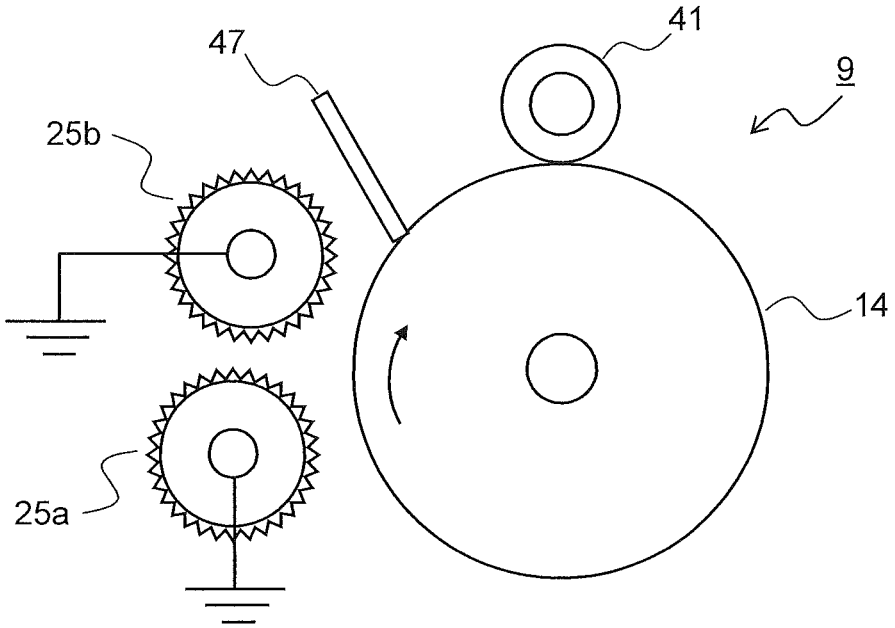
FIG. 8 is a partial enlarged view of the image forming portion 9 and its periphery of the image forming apparatus 100 according to a fourth embodiment of the present disclosure.
Figure 9:
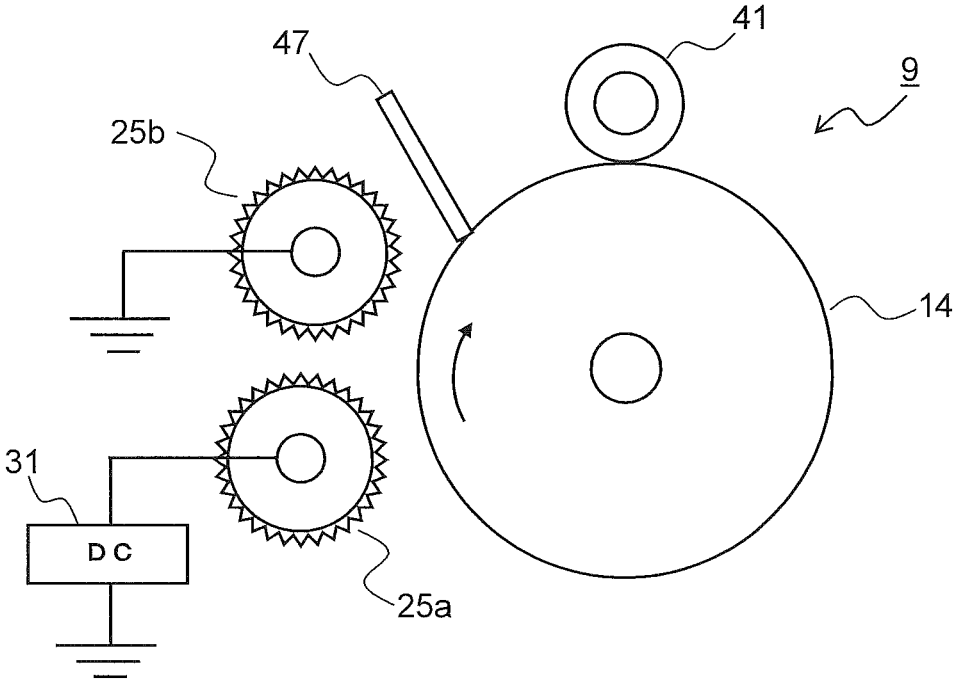
FIG. 9 is a partial enlarged view of the image forming portion and its periphery illustrating a variation of the image forming apparatus of the fourth embodiment.

FIG. 8 is a partial enlarged view of the image forming portion 9 and its periphery of the image forming apparatus 100 according to a fourth embodiment of the present disclosure. FIG. 9 is a partial enlarged view of the image forming portion 9 and its periphery illustrating a variation of the image forming apparatus 100 according to the fourth embodiment. In this embodiment, a first charge eliminating roller 25*a* is disposed on the upstream side in the rotation direction of the photosensitive drum 14, and a second charge eliminating roller 25*b* is disposed on the downstream side of the first charge eliminating roller 25*a*.

Because the first charge eliminating roller 25*a* and the second charge eliminating roller 25*b* are disposed along the circumferential direction of the photosensitive drum 14, the discharge points of the first charge eliminating roller 25*a* and the discharge points of the second charge eliminating roller 25*b* are added, and hence the charge elimination efficiency becomes higher than the case where the single charge eliminating roller 25 is disposed.

In addition, in the case of the noncontact charge elimination method, the charge elimination performance is different between a solid part and an edge part of the electrostatic latent image formed on the surface of the photosensitive drum 14. At the edge part of the electrostatic latent image, a strong edge electric field is generated. As a result, the electric field of the charge elimination is along the edge electric field (diffracted electric field), and hence the charge elimination effect is lowered. Therefore, the charge elimination becomes more difficult at the edge part than in the solid part. In order to secure the charge elimination at the edge part, it is necessary to perform discharge of a polarity opposite to the surface potential of the photosensitive drum 14, but in this case, the solid part is excessively charge-eliminated (oppositely electrified).

Therefore, when two charge eliminating rollers 25 are disposed, it is preferred that the DC voltage can be applied to the first charge eliminating roller 25*a* on the upstream side in the rotation direction of the photosensitive drum 14, and that the second charge eliminating roller 25*b* on the downstream side should be connected to the ground, as illustrated in FIG. 9. With this structure, the voltage having the opposite polarity to the surface potential of the photosensitive drum 14 is applied to the first charge eliminating roller 25*a*, and hence the charge elimination can be securely performed at the edge part of the electrostatic latent image. In addition, when the solid part of the electrostatic latent image is excessively charge-eliminated (oppositely electrified), the second charge eliminating roller 25*b* can reset the surface potential in the solid part to 0 V.

Figure 10:
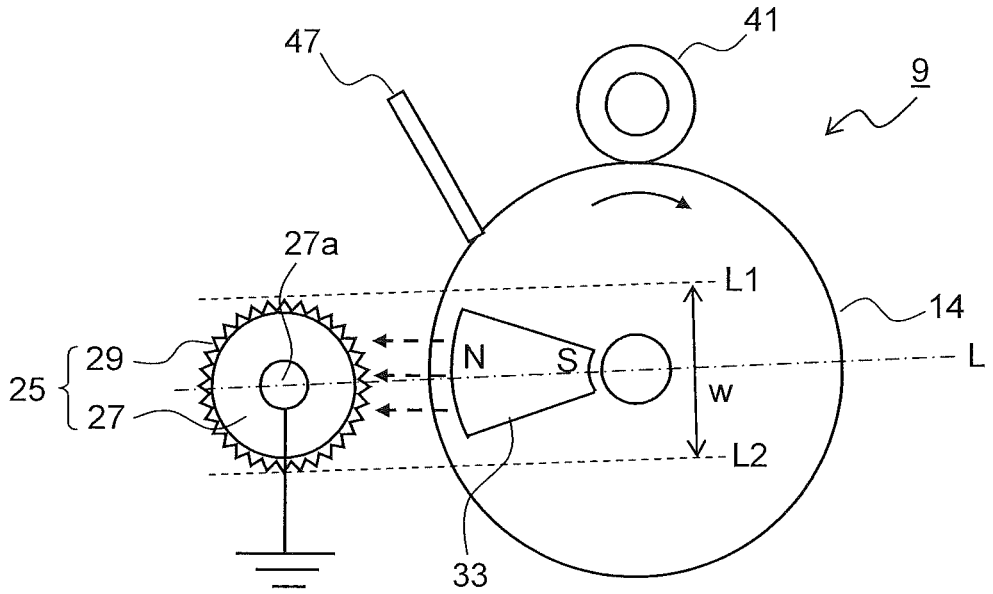
FIG. 10 is a partial enlarged view of the image forming portion and its periphery of the image forming apparatus according to a fifth embodiment of the present disclosure.

FIG. 10 is a partial enlarged view of the image forming portion 9 and its periphery of the image forming apparatus 100 according to a fifth embodiment of the present disclosure. In this embodiment, a magnet member 33 is disposed inside the photosensitive drum 14, and a magnetic pole (north pole in this description) of the magnet member 33 is opposed to the charge eliminating roller 25.

Magnetic lines of force (broken line arrows in FIG. 10) generated from the magnetic pole of the magnet member 33 make directions of the metal fibers protruding from the electro conductive knit fabric 29 constituting the charge eliminating roller 25 be along the magnetic lines of force so as to concentrate in the facing area between the photosensitive drum 14 and the charge eliminating roller 25 (charge elimination nip width). In this way, the discharge points (fiber tips) of the electro conductive knit fabric 29 are increased so that the charge elimination effect is improved. Note that the charge elimination nip width is a width w between two tangential lines L1 and L2 of the outer circumference surface of the charge eliminating roller 25, which are parallel to the straight line L passing through the rotation center of the photosensitive drum 14 and the center of the support shaft 27*a* of the charge eliminating roller 25.

Note that, similarly to the second embodiment, the charge eliminating roller 25 may be rotated in the opposite direction to the photosensitive drum 14 in the surface facing the same in this embodiment, too. Further, similarly to the third embodiment, the voltage having the opposite polarity to the surface potential of the photosensitive drum 14 may be applied to the charge eliminating roller 25. In addition, similarly to the fourth embodiment, a plurality of charge eliminating rollers 25 may be disposed along the circumferential direction of the photosensitive drum 14.

Figure 11:
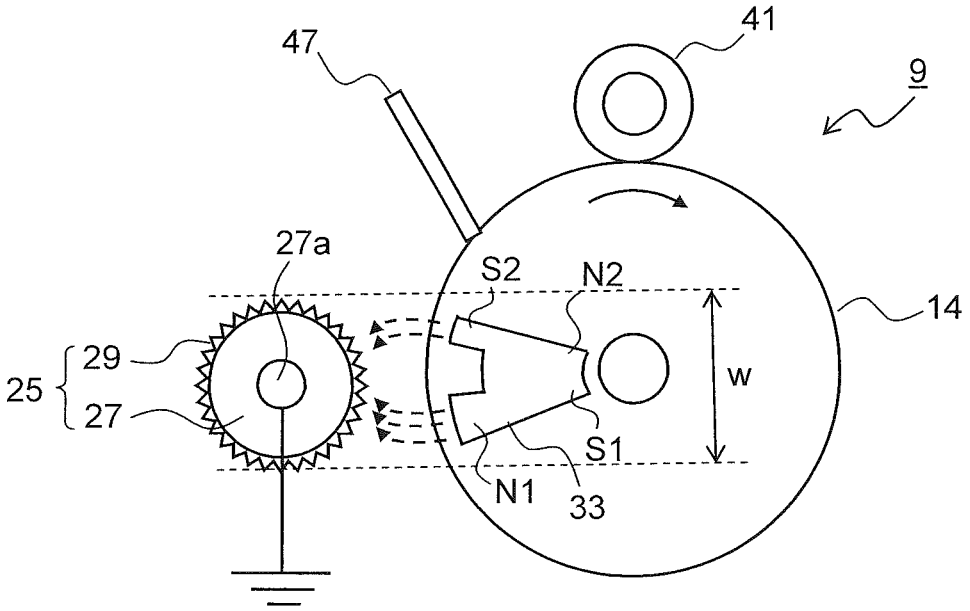
FIG. 11 is a partial enlarged view of the image forming portion and its periphery of the image forming apparatus according to a sixth embodiment of the present disclosure, having a structure in which magnetic poles N1 and S2 (N1>S2) having different magnetic forces and polarities are opposed to the charge eliminating roller.

FIG. 11 is a partial enlarged view of the image forming portion 9 and its periphery of the image forming apparatus 100 according to a sixth embodiment of the present disclosure. In this embodiment, similarly to the fifth embodiment, the magnet member 33 is disposed inside the photosensitive drum 14. The magnet member 33 has two magnetic poles having maximum peaks with different magnetic forces (N1>S2 in this description), which are disposed to face the charge eliminating roller 25 in the charge elimination nip width w.

With the structure of this embodiment, directions of metal fibers protruding from the electro conductive knit fabric 29 are set along the magnetic lines of force generated from the magnetic poles N1 and S2 so as to concentrate in the charge elimination nip width w. In this way, similarly to the fifth embodiment, the discharge points of the electro conductive knit fabric 29 are increased, so that the charge elimination effect is improved.

In addition, because two magnetic poles N1 and S2 having different magnetic forces are used, it is possible to avoid insufficient charge elimination after forming an image pattern such as a character or a thin line having a strong edge electric field. As described above, in the electrostatic latent image having a strong edge electric field, single charge elimination may not sufficient to completely eliminate remaining charge at the edge part because of an influence of the diffracted electric field. Therefore, the two magnetic poles N1 and S2 are disposed to face the charge eliminating roller in this embodiment. First charge elimination in the part facing the magnetic pole N1 weaken the diffracted electric field at the edge part, and second charge elimination in the part facing the magnetic pole S2 can uniformly eliminate charge in the entire electrostatic latent image.

Therefore, even if the image pattern has a strong edge electric field so that charge elimination is difficult, charge elimination performance can be improved. Note that, concerning magnitudes of the magnetic forces of the two magnetic poles, it is effective to set the magnetic force of the magnetic pole N1 on the upstream side in the rotation direction of the photosensitive drum 14 to be larger than the magnetic force of the magnetic pole S2 on the downstream side. Note that, in this embodiment too, the charge eliminating roller 25 may be rotated in the opposite direction in the surface facing the photosensitive drum 14 similarly to the second embodiment, and a voltage having a polarity opposite to the surface potential of the photosensitive drum 14 may be applied to the charge eliminating roller 25 similarly to the third embodiment.

In addition, because the two magnetic poles facing the charge eliminating roller 25 have different polarities (N1 and S2), magnetic lines of force along the circumferential direction of the photosensitive drum 14 are generated between the magnetic poles N1 and S2. As a result, the metal fiber tips of the electro conductive knit fabric 29 constituting the charge eliminating roller 25 are laid down along magnetic lines of force so as to hardly contact with the surface of the photosensitive drum 14. Therefore, the charge eliminating roller 25 can be disposed close to the photosensitive drum 14 so that a gap between the photosensitive drum 14 and the charge eliminating roller 25 is stabilized, and hence charge elimination accuracy can be improved.

Figure 12:
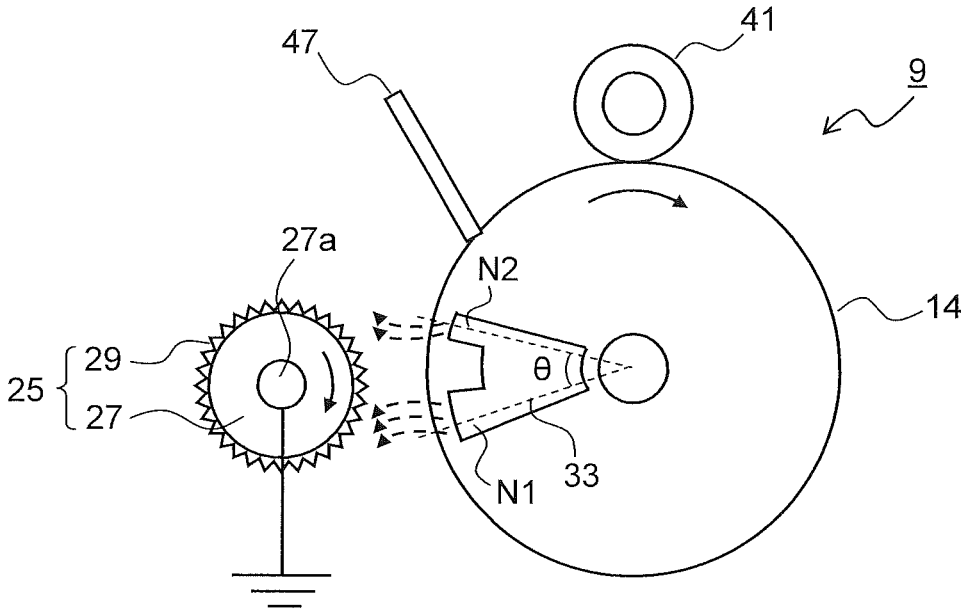
FIG. 12 is a partial enlarged view of the image forming portion and its periphery of the image forming apparatus according to the sixth embodiment, having a structure in which magnetic poles N1 and N2 (N1>N2) having different magnetic forces and the same polarity are opposed to the charge eliminating roller.

In addition, although the magnetic poles N1 and S2 having different magnetic forces and different polarities are disposed to face the charge eliminating roller 25 in FIG. 11, the magnetic poles N1 and N2 (N1>N2) having different magnetic forces and the same polarity may be disposed to face the charge eliminating roller 25 as illustrated in FIG. 12. In particular, when the charge eliminating roller 25 is rotated similarly to the second embodiment, because the two magnetic poles have the same polarity, the metal fibers protruding from the electro conductive knit fabric 29 are steeply bent when passing though the repulsive magnetic field between the magnetic poles N1 and N2. As a result, contaminant such as toner or dust from the photosensitive drum 14 hardly sticks to the metal fibers, and hence a period of endurance (life) of the electro conductive knit fabric 29 can be elongated.

Note that, in the structure of FIG. 12, if a magnetic pole center angle θ of the magnetic poles N1 and N2 (an angle between magnetic force peaks of the two magnetic poles disposed in the radial direction radially from the rotation center of the photosensitive drum 14) is too large, the repulsive magnetic field between the magnetic poles N1 and N2 is hardly directed to the inside of the charge elimination nip width w. In addition, if the magnetic pole center angle θ is too small, the repulsive magnetic field itself becomes weak. Therefore, it is preferred to set the magnetic pole center angle θ of the magnetic poles N1 and N2 to approximately 25 to 30 degrees.

Figure 13:
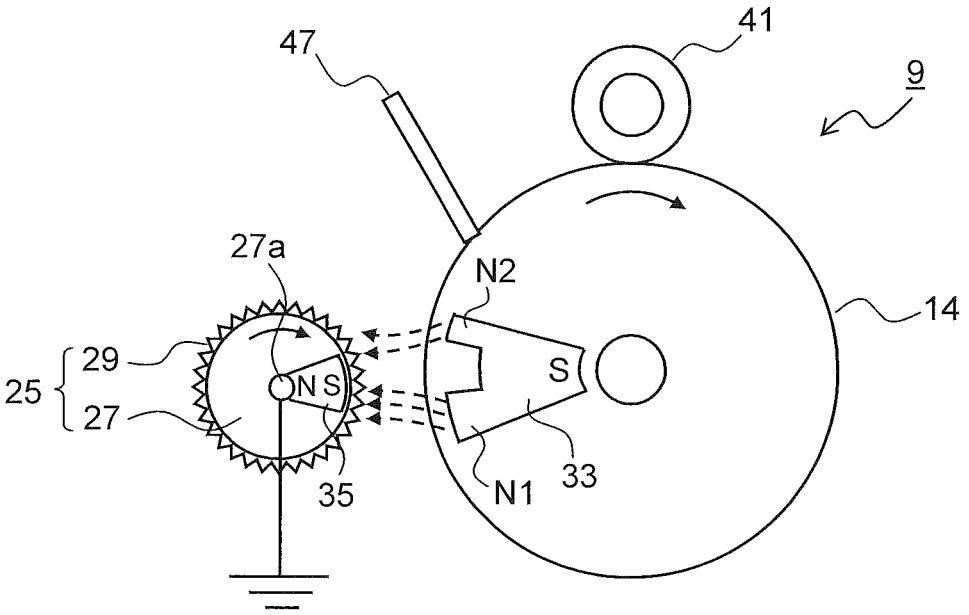
FIG. 13 is a partial enlarged view of the image forming portion and its periphery of the image forming apparatus according to a seventh embodiment of the present disclosure.

FIG. 13 is a partial enlarged view of the image forming portion 9 and its periphery of the image forming apparatus 100 according to a seventh embodiment of the present disclosure. In this embodiment, in addition to the structure of the sixth embodiment, a charge eliminating roller side magnet 35 is disposed inside the support member 27 constituting the charge eliminating roller 25. The charge eliminating roller side magnet 35 is disposed to face the magnet member 33 disposed inside the photosensitive drum 14, and the charge eliminating roller side magnet 35 has a magnetic pole S of a polarity opposite to the magnetic poles N1 and N2 of the magnet member 33. Other parts have the same structure as in the sixth embodiment illustrated in FIG. 12.

With the structure of this embodiment, strong magnetic lines of force are generated between the magnetic pole S of the charge eliminating roller side magnet 35 and the magnetic poles N1 and N2 of the magnet member 33. As a result, directions of the metal fibers protruding from the electro conductive knit fabric 29 are set along the magnetic lines of force so as to concentrate in the charge elimination nip width w. In this way, discharge points of the electro conductive knit fabric 29 are increased more than the sixth embodiment, and hence the charge elimination effect is further improved.

Note that, in this example, the charge eliminating roller side magnet 35 has the magnetic pole S of a polarity opposite the two magnetic poles N1 and N2 of the magnet member 33, but the charge eliminating roller side magnet 35 may have the magnetic pole of the same polarity as the two magnetic poles of the magnet member 33. In addition, two magnetic poles of the magnet member 33 may have different polarities (N1 and S2) as illustrated in FIG. 11.

Figure 14:
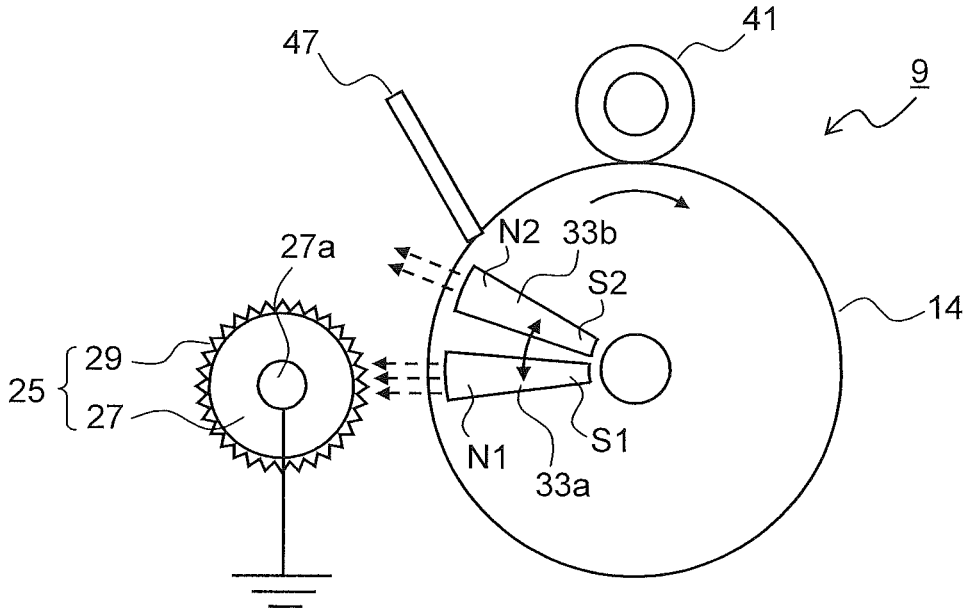
FIG. 14 is a partial enlarged view of the image forming portion and its periphery of the image forming apparatus according to an eighth embodiment of the present disclosure.

FIG. 14 is a partial enlarged view of the image forming portion 9 and its periphery of the image forming apparatus 100 according to an eighth embodiment of the present disclosure. In this embodiment, two magnet members including a first magnet member 33*a* and a second magnet member 33*b* are disposed inside the photosensitive drum 14. The magnetic pole N1 of the first magnet member 33*a* has a larger magnetic force than the magnetic pole N2 of the second magnet member 33*a*. The first magnet member 33*a* and the second magnet member 33*b* can move in a reciprocating manner in the circumferential direction of the photosensitive drum 14.

Further, a position in which magnetic pole N1 of the first magnet member 33*a* is positioned within the charge elimination nip width w (first position) as illustrated in FIG. 14 and a position in which the magnetic pole N2 of the second magnet member 33*b* is positioned within the charge elimination nip width w (second position) can be switched.

The image forming apparatus 100 can switch a process linear speed in two steps in accordance with a thickness and a type of the conveyed paper sheet. For example, when the paper sheet is normal paper, the image formation process is performed at a normal drive speed (hereinafter referred to as a full speed mode). When the paper sheet is thick paper, the image formation process is performed at a speed lower than the normal speed (hereinafter referred to as a deceleration mode). In this way, when using thick paper, sufficient fixing time is secured so that image quality can be improved.

Here, when the image formation process is performed in the deceleration mode, a period of time while the surface of the photosensitive drum 14 passes through the charge elimination nip width w becomes long. As a result, the charge elimination performance becomes excessive, and hence, when the next electrostatic latent image is formed, the surface potential is decreased so that there easily occurs a malfunction that density of a half-tone image becomes thick or dot reproducibility is deteriorated.

In addition, with the structure in which the magnet member 33 is disposed inside the photosensitive drum 14, when the image forming apparatus 100 is left to stand for a long period of time, the magnetic force of the magnet member 33 causes remanent magnetization in the metal fibers of the electro conductive knit fabric 29. Therefore, when performing the image formation process after being left to stand for a long period of time, the remanent magnetization of the metal fibers may cause a lateral stripe image.

Further, in a special mode to be executed when restoring from a high temperature and high humidity environment, for example, when the electrifying roller 41 electrifies the photosensitive drum 14 weakly so as to perform a drum refresh operation for removing moisture in the photosensitive drum 14 and its peripheral members, weak electrification control is performed in which the surface potential of the photosensitive drum 14 is set lower than that in the normal image formation. In this case, because the surface potential of the photosensitive drum 14 is decreased, the self-discharge phenomenon is lowered so that the charge elimination becomes insufficient, and desired refresh effect may not be obtained.

Therefore, in this embodiment, the magnet member facing the charge eliminating roller 25 is switched between the first magnet member 33*a* and the second magnet member 33*b*, and hence it is possible to obtain the charge elimination performance according to a state of the image forming apparatus 100. For example, when performing the image formation process in the deceleration mode, the magnetic pole N2 of the second magnet member 33*b* is set to face the charge eliminating roller 25 (second position), and hence it is possible to prevent excessive charge elimination due to a decrease in the linear speed of the photosensitive drum 14. In addition, when performing the drum refresh operation, the magnetic pole N1 of the first magnet member 33*a* is set to face the charge eliminating roller 25 (first position), and hence insufficiency of the charge elimination in the weak electrification control is decreased. Thus, sufficient weak electrification to an extent that a pinhole is not generated is performed so that moisture in the photosensitive drum 14 and its peripheral members can be sufficiently removed.

In addition, when a voltage is applied to the charge eliminating roller 25 so that the remaining charge on the photosensitive drum 14 is strongly eliminated as in the third embodiment, corona products stick to the metal fibers of the electro conductive knit fabric 29 so that the charge elimination performance is deteriorated. Therefore, in an interval between paper sheets and when printing is finished, positions of the first magnet member 33*a* and the second magnet member 33*b* are switched so that the metal fiber tips are rubbed with each other. Thus, deposition of corona products on the metal fiber is suppressed, and durability of the charge eliminating roller 25 can be improved.

Further, when the image forming apparatus 100 is not used for a long period of time, both the first magnet member 33*a* and the second magnet member 33*b* are moved to the outside of the charge elimination nip width w (third position). Thus, remanent magnetization of the metal fiber is prevented, and hence occurrence of the lateral stripe image can be prevented.

Figure 15:
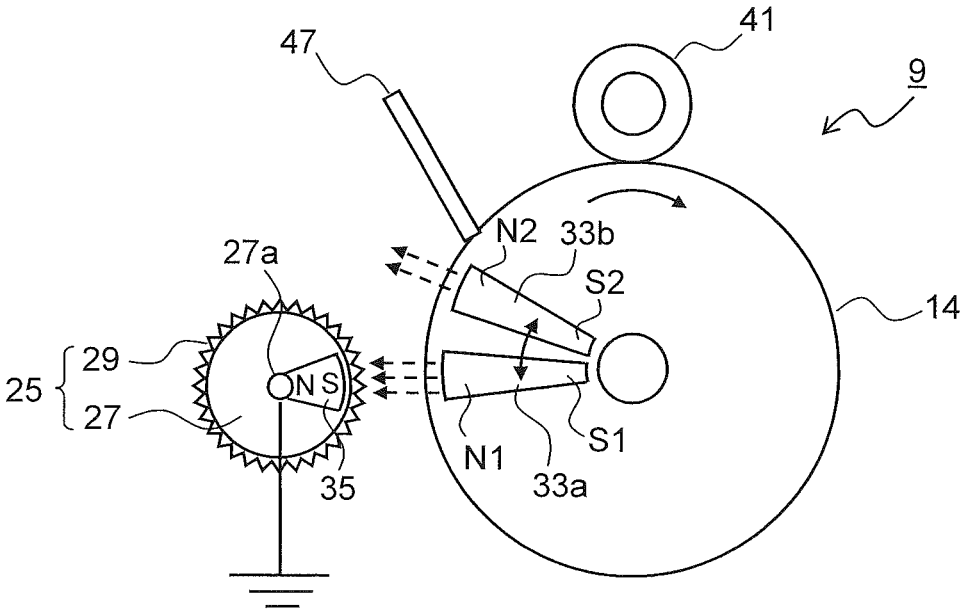
FIG. 15 is a partial enlarged view of the image forming portion and its periphery of the image forming apparatus according to a ninth embodiment of the present disclosure.

FIG. 15 is a partial enlarged view of the image forming portion 9 and its periphery of the image forming apparatus 100 according to a ninth embodiment of the present disclosure. In this embodiment, in addition to the structure of the eighth embodiment, a charge eliminating roller side magnet 35 is disposed inside the support member 27 constituting the charge eliminating roller 25. The charge eliminating roller side magnet 35 is disposed to face the first magnet member 33*a* or the second magnet member 33*b* disposed inside the photosensitive drum 14. The magnetic pole S of the charge eliminating roller side magnet 35 has a polarity opposite to the magnetic poles N1 and N2 of the first magnet member 33*a* and the second magnet member 33*b*. Other parts have the same structure as in the eighth embodiment illustrated in FIG. 14.

With the structure of this embodiment, strong magnetic lines of force are generated between the magnetic pole S of the charge eliminating roller side magnet 35 and the magnetic poles N1 and N2 of the first magnet member 33*a* and the second magnet member 33*b*. As a result, directions of the metal fibers protruding from the electro conductive knit fabric 29 are set along the magnetic lines of force so as to concentrate in the charge elimination nip width w. In this way, discharge points of the electro conductive knit fabric 29 are increased more than the eighth embodiment, and hence the charge elimination effect is further improved.

Note that, in this description, the magnetic pole S of the charge eliminating roller side magnet 35 has a polarity opposite to the two magnetic poles N1 and N2 of the magnet member 33, but the magnetic pole of the charge eliminating roller side magnet 35 may have the same polarity as the two magnetic poles of the magnet member 33.

Other than that, the present disclosure is not limited to the embodiments described above and can be variously modified within the scope of the present disclosure without deviating from the spirit thereof. For example, as a matter of course, a combination structure of the embodiments described above is included in the present disclosure. In addition, instead of the contact electrification type electrifying device 15 using the electrifying roller 41 described above in the embodiments, it is possible to use a corona electrification type electrifying device equipped with a corona wire and a grid. In addition, instead of the one-component developing type developing device 16, it is possible to use a two-component developing type developing device using two-component developer containing toner and magnetic carrier.

In addition, in the embodiments described above, there is described an example in which the discharge member including the electro conductive knit fabric 29 mounted on the cylindrical support member 27 is applied to the charge eliminating roller 25 for eliminating remaining charge on the photosensitive drum 14. However, the discharge member using the support member 27 and the electro conductive knit fabric 29 can be used not only for the charge eliminating roller 25 but also for charge elimination of transfer paper or charge elimination of a fixing roller or the like. Further, depending on the voltage to be applied, it can be used also as the discharge member used for electrification of the photosensitive drum 14, for collecting carriers adhered to the photosensitive drum 14, or for increasing electrification amount of toner developed on the photosensitive drum 14.

Further, the image forming apparatus of the present disclosure is not limited to the monochrome printer illustrated in FIG. 1 but may be other image forming apparatuses such as monochrome and color copiers, a digital multifunction peripheral, a color printer, and a facsimile machine. Hereinafter, with reference to Examples, effects of the present disclosure are further described specifically.

Example 1

The charge elimination performance and durability performance of the charge eliminating roller 25 were evaluated using the image forming apparatus 100 of the first to third and fifth embodiments including the image forming portion 9 illustrated in FIGS. 2, 5 to 7, and 10 (Present Disclosures 1 to 9). As to the charge elimination performance, it was checked whether or not a desired potential after charge elimination can be obtained after the charge elimination of the remaining charge on the photosensitive drum 14 by the charge eliminating roller 25. As to the durability performance, it was checked whether or not there is a stripe image after outputting 50,000 sheets with half-tone images having a printing rate of 25%.

As to the test conditions, an FS-13200 modified machine (made by KYOCERA Document Solutions Inc.) was used as the image forming apparatus 100, the photosensitive drum 14 was constituted of an OPC formed on an aluminum tube having a diameter of 30 mm, and the linear speed was set to 150 mm/sec. As to the charge eliminating roller 25, the diameter of the support member 27 was set to 12 mm. As to Present Disclosures 1 to 9, a plurality of stainless steel (SUS316L) fibers having fiber diameters of 8 μm, 12 μm, and 20 μm were collected and twisted so as to make the twisted yarn, and the twisted yarn was knitted to make the electro conductive knit fabric 29 having a thickness of 1.05 mm for use. In addition, instead of the electro conductive knit fabric 29, textile fabric and felt made of stainless steel (SUS316L) fibers were used to make the charge eliminating roller 25, and using the image forming apparatus 100 including the charge eliminating roller 25 (Comparative Examples 1 and 2), and using the image forming apparatus 100 including charge eliminating roller 25 made of textile fabric of copper fibers (Comparative Examples 3 and 4) were used so as to perform the same evaluation.

As to evaluation standards of the charge elimination performance, ◎+ represents a case where the surface potential of the photosensitive drum 14 was decreased to 80 V or lower, ◎ represents a case where the surface potential was decreased to 81 V to 100 V, ○+ represents a case where the surface potential was decreased to 101 V to 120 V, ○ represents a case where the surface potential was decreased to 121 V to 140 V, Δ represents a case where the surface potential was decreased to 141 V to 160 V, and × represents a case where the surface potential was decreased to a 160 V or higher. The cases of ◎+ to Δ were evaluated to have no problem in practice. As to evaluation standards of the durability performance, ◎ represents a case where there was no stripe in the half-tone image after printing 50,000 sheets, ○ represents a case where there was a slight stripe that was not minded, Δ represents a case where there was a stripe that was a little minded. The cases of ◎ to Δ were evaluated to have no problem in practice. Table 1 shows these results together with the structures of the charge eliminating roller and the magnet member.

TABLE 1

| | charge eliminating roller | | | | | | | | | |
|---|---|---|---|---|---|---|---|---|---|---|
| | electro conductive member | | | | | | magnet member | | | |
| | material | fiber diameter (μm) | shape | | voltage | throughhole | with or W/O | magnetic force (mT) | charge elimination performance | durability performance |
| Present Disclosure 1 | stainless steel | 8 | fixed | knit fabric | ground | W/O | W/O | — | ○ | ○ |
| Present Disclosure 2 | stainless steel | 12 | rotation (※1) | knit fabric | ground | W/O | W/O | — | ◎ | ○ |
| Present Disclosure 3 | stainless steel | 12 | fixed | knit fabric | with (※3) | W/O | W/O | — | ◎ | Δ |

TABLE 1-continued

| | charge eliminating roller | | | | | | | | | |
|---|---|---|---|---|---|---|---|---|---|---|
| | electro conductive member | | | | | | magnet member | | | |
| | material | fiber diameter (μm) | shape | | voltage | throughhole | with or W/O | magnetic force (mT) | charge elimination performance | durability performance |
| Present Disclosure 4 | stainless steel | 8 | fixed | knit fabric | ground | with | W/O | — | ◎ | ◎ |
| Present Disclosure 5 | stainless steel | 20 | fixed | knit fabric | ground | W/O | with | 30 | ○ | ○ |
| Present Disclosure 6 | stainless steel | 8 | fixed | knit fabric | ground | W/O | with | 30 | ◎ | ○ |
| Present Disclosure 7 | stainless steel | 20 | fixed | knit fabric | ground | W/O | with | 80 | ○+ | ○ |
| Present Disclosure 8 | stainless steel | 20 | rotation (※2) | knit fabric | ground | W/O | with | 30 | ◎ | ○ |
| Present Disclosure 9 | stainless steel | 20 | rotation (※2) | knit fabric | with (※3) | W/O | with | 30 | ◎+ | Δ |
| Comparable Example 1 | stainless steel | 8 | fixed | textile fabric | ground | W/O | W/O | — | × | ○ |
| Comparable Example 2 | stainless steel | 8 | fixed | felt | ground | W/O | W/O | — | × | ○ |
| Comparable Example 3 | copper | 8 | fixed | textile fabric | ground | W/O | W/O | — | × | ○ |
| Comparable Example 4 | copper | 8 | fixed | textile fabric | with (※3) | W/O | with | 80 | × | Δ |

※1: rotate at linear speed ratio of 1.5 in counter direction to rotation direction of photosensitive drum
※2: rotate at linear speed ratio of 0.8 in counter direction to rotation direction of photosensitive drum
※3: apply DC voltage having opposite polarity to surface potential of photosensitive drum As clear from Table 1, with each of the structures of Present Disclosures 1 to 9, in which twisted yarn made of twisted stainless steel fibers is knitted to make the electro conductive knit fabric 29 for use, the surface potential of the photosensitive drum was decreased to 140 V or lower. In particular, with the structure of Present Disclosure 2 in which the charge eliminating roller 25 is rotated in the counter direction to the photosensitive drum 14, and with the structure of Present Disclosure 3 in which the DC voltage having the opposite polarity to the photosensitive drum 14 is applied to the charge eliminating roller 25, the surface potential of the photosensitive drum was decreased to 80 V or lower even with the stainless steel fibers having a fiber diameter of 12 μm.

In addition, also with the structure of Present Disclosure 4 in which the through holes 30 are formed in the outer circumference surface of the hollow support member 27, and air flow is sent from the support shaft 27*a*, the surface potential of the photosensitive drum was decreased to 80 V or lower. In addition, the electro conductive knit fabric 29 was hardly contaminated, and there was no occurrence of the stripe image after printing 50,000 sheets. In addition, with the structures of Present Disclosures 5 to 9 in which the magnet member 33 is disposed inside the photosensitive drum 14, the charge elimination performance was more improved even with the stainless steel fibers having a fiber diameter of 20 μm.

In contrast to this, with the structure of Comparative Example 1, in which textile fabric of stainless steel fibers, instead of the electro conductive knit fabric 29, is adhered to the support member 27, raised parts of the stainless steel fiber were not many enough to obtain sufficient charge elimination performance. In addition, with the structure of Comparative Example 2, in which felt of stainless steel fibers is adhered to the support member 27, there were many raised parts of the felt so that high charge elimination performance was obtained, but unevenness of charge elimination occurred because of unevenness of the raised parts depending on place in the felt.

In addition, with the structure of Comparative Example 3 in which textile fabric of copper fiber is adhered instead of the stainless steel fiber, sufficient charge elimination performance was not obtained. The same was true with the structure of Comparative Example 4 in which the DC voltage having the opposite polarity to the photosensitive drum 14 is applied to the charge eliminating roller 25, and the magnet member 33 is disposed inside the photosensitive drum 14.

Example 2

Using the image forming apparatus 100 of the sixth embodiment (Present Disclosures 10 to 14) including the photosensitive drum 14, inside which the magnet member 33 having two magnetic poles with maximum peaks and different magnetic forces is disposed as illustrated in FIGS. 11 and 12, charge elimination performance of the charge eliminating roller 25, image memory, and durability performance were evaluated. In addition, using the image forming apparatus 100 (Comparative Example 5) including the photosensitive drum 14 inside which no magnet member is disposed, and the image forming apparatus 100 (Comparative Examples 6 to 8) including the photosensitive drum 14, inside which the magnet member 33 having only one magnetic pole is disposed, the same evaluation was performed. The test methods, the test conditions, and the evaluation standards of the charge elimination performance and the durability performance are the same as those in Example 1. As to the image memory, it was checked whether or not there was an image memory due to insufficient charge elimination at an edge part of a character generated at the first rotation of the photosensitive drum 14 when printing a character pattern. Symbol ◎ represents a case where there was no occurrence of the memory, ○ represents a case where there was an occurrence of the memory that was not minded, and Δ represents a case where there was an occurrence of the memory that was a little minded. The cases of ◎ to Δ were evaluated to have no problem in practice. Table 2 shows these results together with the structures of the charge eliminating roller and the magnet member.

TABLE 2

| | charge eliminating roller | | | | | magnet member | | | evaluation | | |
|---|---|---|---|---|---|---|---|---|---|---|---|
| | electro conductive member | | | | | one pole (mT) | two poles (mT) (※3) | | charge | | |
| | material | fiber diameter (μm) | shape | | voltage | | difference polarities | same polarity | elimination performance | memory | durability performance |
| Present Disclosure 10 | stainless steel | 8 | Rotation (※1) | knit fabric | ground | — | 30-80 | — | ○+ | ○ | ○ |
| Present Disclosure 11 | stainless steel | 8 | Rotation (※1) | knit fabric | ground | — | 80-30 | — | ○+ | ◎ | ○ |
| Present Disclosure 12 | stainless steel | 8 | Rotation (※1) | knit fabric | ground | — | — | 30-80 | ○+ | ○ | ◎ |
| Present Disclosure 13 | stainless steel | 8 | Rotation (※1) | knit fabric | ground | — | — | 80-30 | ○+ | ◎ | ◎ |
| Present Disclosure 14 | stainless steel | 8 | Rotation (※1) | knit fabric | with (※2) | — | — | 80-30 | ◎ | ◎ | Δ |
| Comparable Example 5 | copper | 8 | fixed | knit fabric | ground | — | — | — | × | Δ | ○ |
| Comparable Example 6 | stainless steel | 20 | fixed | knit fabric | ground | 50 | — | — | ○ | Δ | ○ |
| Comparable Example 7 | stainless steel | 8 | Rotation (※1) | knit fabric | ground | 50 | — | — | ○+ | Δ | ○ |
| Comparable Example 8 | copper | 8 | fixed | textile fabric | with (※2) | 80 | — | — | × | — | Δ |

※1: rotate at linear speed ratio of 0.8 in counter direction to rotation direction of photosensitive drum ※2: apply DC voltage having opposite polarity to surface potential of photosensitive drum ※3: magnetic force of magnetic poles from upstream side to downstream side in rotation direction of photosensitive drum in order from left to right As clear from Table 2, in each of Present Disclosures 10 to 14, in which the magnet member 33 having two magnetic poles with maximum peaks and different magnetic forces is disposed inside the photosensitive drum 14, the surface potential of the photosensitive drum was decreased to 120 V or lower. In addition, the entire photosensitive drum 14 was uniformly charge-eliminated without insufficient charge elimination at an edge part of a character pattern. Further, comparing Present Disclosures 10 and 11 in which the two magnetic poles have different polarities with Present Disclosures 12 and 13 in which the two magnetic poles have the same polarity, durability performance is improved more in Present Disclosures 12 and 13. This is considered to be because, with the structure of Present Disclosures 12 and 13, the metal fibers protruding from the electro conductive knit fabric 29 are steeply bent when passing through the repulsive magnetic field between the magnetic poles, and hence contaminant such as toner or dust from the photosensitive drum 14 hardly sticks to the metal fibers.

In contrast to this, in Comparative Examples 5 and 8 in which the textile fabric of copper fibers is adhered to the support member 27, sufficient charge elimination performance was not obtained. In addition, in Comparative Examples 6 and 7 in which the magnet member 33 having only one magnetic pole is disposed inside the photosensitive drum 14, sufficient charge elimination performance and durability performance were obtained, but it was admitted there was an occurrence of the memory that was a little minded due to insufficient charge elimination at an edge part of a character pattern.

Example 3

Using the image forming apparatus 100 of the eighth embodiment (Present Disclosure 15 to 20) including the photosensitive drum 14, inside which the first magnet member 33*a* and the second magnet member 33*b* are disposed as illustrated in FIG. 14, and positions of the first magnet member 33*a* and the second magnet member 33*b* are switched in accordance with a state of the image forming apparatus 100, charge elimination performance and durability performance of the charge eliminating roller 25 were evaluated in durability printing (of 50,000 sheets) and after being left for a long period of time (8 hours). In addition, the charge elimination performance of the charge eliminating roller 25 and density unevenness in a half speed mode (at half speed of the normal printing speed), and the charge elimination performance of the charge eliminating roller 25 and occurrence of pinhole in a drum refresh (DR) operation were also evaluated.

The test methods, the test conditions, and the evaluation standards of the charge elimination performance and the durability performance are the same as those in Examples 1 and 2. As to the density unevenness, ◎ represents a case where there was no density unevenness when printing a half-tone image at the half speed mode, ○ represents a case where there was density unevenness that was not minded, and Δ represents a case where there was density unevenness that was a little minded. As to the pinhole, ◎ represents a case where there was no occurrence of pinhole, and ○ represents a case where there was a very small pinhole that was not minded.

In addition, using the image forming apparatus 100 (Comparative Example 9) including the charge eliminating roller 25 in which textile fabric made of copper is used instead of the electro conductive knit fabric 29, and no magnet member is disposed, and the image forming apparatus 100 (Comparative Examples 10 to 13) in which the magnetic force of the magnet member is not switched, the same evaluation was performed. Tables 3 to 5 show these results together with the structures of the charge eliminating roller and the magnet member.

TABLE 3

| | | charge eliminating roller | | | | | | | | | |
|---|---|---|---|---|---|---|---|---|---|---|---|
| | | electro conductive member | | | | | magnet member | | | | |
| state | | material | fiber diameter (μm) | shape | | voltage | with or W/O | magnetic force (mT) | magnetic force switching | charge elimination performance | durability performance |
| durability printing | Present Disclosure 15 | stainless steel | 20 | fixed | knit fabric | ground | with | 50→80 | with (※4) | ○ | ◎ |
| | Comparable Example 9 | copper | 8 | fixed | textile fabric | ground | W/O | — | — | × | ○ |
| | Comparable Example 10 | stainless steel | 20 | fixed | kint fabric | ground | with | 50 | W/O | ○ | ○ |
| left for long period | Present Disclosure 16 | stainless steel | 8 | fixed | knit fabric | ground | with | 50→0 | with (※5) | ◎ | ○ |
| | Comparable Example 11 | stainless steel | 8 | fixed | kint fabric | ground | with | 50 | W/O | ◎ | Δ |
| normal printing | Present Disclosure 17 | stainless steel | 8 | rotation (※1) | knit fabric | with (※3) | with | 50→30 50→0 | with (※6) | ◎ | ◎ |

TABLE 4

| | | charge eliminating roller | | | | | | | | | |
|---|---|---|---|---|---|---|---|---|---|---|---|
| | | electro conductive member | | | | | magnet member | | | | |
| state | | material | fiber diameter (μm) | shape | | voltage | with or W/O | magnetic force (mT) | magnetic force switching | charge elimination performance | durability performance |
| half speed | Present Disclosure 18 | stainless steel | 8 | rotation (※1) | knit fabric | ground | with | 50→30 | with (※7) | ◎ | ○ |
| | Present Disclosure 19 | stainless steel | 8 | rotation (※2) | knit fabric | ground | with | 50→30 | with (※7) | ◎ | ◎ |
| | Comparable Example 12 | stainless steel | 8 | rotation (※1) | kint fabric | ground | with | 50 | W/O | ◎ | Δ |

TABLE 5

| | | charge eliminating roller | | | | | | | | | |
|---|---|---|---|---|---|---|---|---|---|---|---|
| | | electro conductive member | | | | | magnet member | | | | |
| state | | material | fiber diameter (μm) | shape | | voltage | with or W/O | magnetic force (mT) | magnetic force switching | charge elimination performance | pinhole |
| DR | Present Disclosure 20 | stainless steel | 8 | rotation (※2) | knit fabric | ground | with | 50→80 | with (※6) | ◎ | ◎ |
| | Comparable Example 13 | stainless steel | 8 | rotation (※1) | kint fabric | ground | with | 50 | W/O | ◎ | ○ |

※1: rotate at linear speed ratio of 0.8 in counter direction to rotation direction of photosensitive drum
※2: rotate at linear speed ratio of 0.4 in counter direction to rotation direction of photosensitive drum
*3: apply DC voltage having opposite polarity to surface potential of photosensitive drum
*4: 50 mT in durability first half (up to 35,000th sheet), and switch to 80 mT in durability second half (35,001th sheet and after)
*5: remove both magnet members from the charge elimination nip width when leaving for a long period of time
※6: switch from 50 mT to 30 mT between paper sheets, and switch from 50 mT to 0 mT when finishing printing
*7: switch from 50 mT to 30 mT when switching from full speed mode to half speed mode
*8: switch from 50 mT to 80 mT in drum refresh operation As clear from Table 3, in Present Disclosure 15 in which the magnetic force of the magnet member is switched from 50 mT to 80 mT in the second half of the durability printing, there was no stripe in the half-tone image after printing 50,000 sheets, and the durability performance was improved compared with Comparative Example 10 in which the magnetic force was not switched from 50 mT. In the photosensitive drum 14 using the organic photosensitive layer, abrasion (to become thinner) of the photosensitive layer due to durability printing causes an increase in electrification charge density. In addition, when contaminant such as scattering toner or the like deposits on the charge eliminating roller 25, the charge elimination performance is deteriorated. As a result, higher charge elimination performance is required in the end stage of the durability period than in the early stage. Therefore it is preferred to set a higher magnetic force in the durability second half than in the durability first half so as to increase density of the stainless steel fiber tips of the electro conductive knit fabric 29 directed to the inside of the charge elimination nip width, and hence to increase the charge elimination performance.

In addition, in Present Disclosure 16 in which both the first magnet member 33*a* and the second magnet member 33*b* are removed from the charge elimination nip width and are left for a long period of time, occurrence of stripes in the half-tone image after printing 50,000 sheets was reduced compared with Comparative Example 11 in which one of the first magnet member 33*a* and the second magnet member 33*b* is set to face the charge elimination nip width and is left for a long period of time, and hence durability performance was improved. This is because, in Present Disclosure 16, remanent magnetization of the stainless steel fibers constituting the electro conductive knit fabric 29 was suppressed, and hence stable charge elimination performance was maintained also after being left for a long period of time.

Further, in Present Disclosure 17 in which the magnetic force of the magnet member is switched a plurality of times between paper sheets and when printing is finished, occurrence of stripes in the half-tone image after printing 50,000 sheets was reduced. This is because when the magnetic force is switched, the stainless steel fiber tips of the electro conductive knit fabric 29 were rubbed by each other so that deposition of corona products was suppressed. Note that sufficient charge elimination performance was not obtained in Comparative Example 9 in which the textile fabric of copper fibers is adhered instead of the stainless steel fibers.

In addition, as clear from Table 4, in Present Disclosures 18 and 19 in which the magnetic force is lowered when switching from the full speed mode to the half speed mode, occurrence of density unevenness when printing a half-tone image at the half speed mode was suppressed more than in Comparative Example 12 in which the magnetic force is not switched. This is because of the following reason. In the half speed mode, a period of time while the surface of the photosensitive drum 14 passes through the charge elimination nip width becomes long, and hence density unevenness may occur when the charge elimination effect becomes too strong. However, when the magnetic force is lowered in the half speed mode as in Present Disclosures 18 and 19, concentration of the stainless steel fiber tips of the electro conductive knit fabric 29 in the charge elimination nip width is relieved, and hence the charge elimination effect is controlled to an appropriate level so that the image quality is constantly maintained. Further, when the linear speed ratio of the charge eliminating roller 25 with respect to the photosensitive drum 14 is lowered so that the charge elimination effect is decreased as in Present Disclosure 19, occurrence of density unevenness can be further reduced.

In addition, as clear from Table 5, in Present Disclosure 20 in which the magnetic force is switched from 50 mT to 80 mT when executing the drum refresh operation, occurrence of pinholes was reduced compared with Comparative Example 13 in which the magnetic force is not switched. In the drum refresh operation in which the photosensitive drum 14 is weakly electrified so that moisture is removed when power is turned on in a high temperature and high humidity environment, the self-discharge phenomenon is lowered because of low electrification potential of the photosensitive drum 14, and hence the charge elimination performance is lowered. Therefore, by switching the magnet member from low magnetic force to high magnetic force so that the charge elimination performance is enhanced, and hence the weak electrification that does not generate a pinhole can sufficiently remove moisture of the photosensitive drum 14.

The present disclosure can be applied to the discharge member for discharging in a noncontact manner with a member to be discharged, the charge eliminating device for eliminating remaining charge on the surface of the image carrier by using the discharge member, and the image forming apparatus including the charge eliminating device. By using the present disclosure, it is possible to provide the discharge member that can perform high efficiency discharging for a long period of time even the member to be discharged has a low potential, the charge eliminating device including the discharge member, and the image forming apparatus.

What is claimed is:

1. An image forming apparatus comprising:

an image carrier having a surface on which a photosensitive layer is formed;

an electrifying member configured to electrify the photosensitive layer on the surface of the image carrier; and a charge eliminating device including a discharge member, the discharge member including:

an electro conductive knit fabric knitted in a cylindrical shape using twisted yarn made of twisted metal fibers; and a support member having a cylindrical shape, the support member being inserted in the electro conductive knit fabric, the discharge member being disposed to face the image carrier in a noncontact manner, in a state where the electro conductive knit fabric is grounded or a voltage is applied to the electro conductive knit fabric, the charge eliminating device generating a discharge between the discharge member and the image carrier so as to eliminate electric charge on the surface of the image carrier, wherein remaining charge on the surface of the image carrier is eliminated by the charge eliminating device, a magnet member is disposed inside the image carrier within a charge elimination nip width between two tangential lines of an outer circumference surface of the discharge member, the two tangential lines being parallel to a straight line passing through a rotation center of the image carrier and a center axis of the discharge member, the magnet member has two magnetic poles with maximum peaks, and the two magnetic poles are disposed within the charge elimination nip width, and the two magnetic poles of the magnet member have the same polarity but have different magnetic forces.

2. The image forming apparatus according to claim 1, wherein the support member has a hollow shape, an air introduction hole is formed in one end in an axis direction of the support member, and a plurality of through holes for air flow to pass through are formed in an outer circumference surface of the support member.

3. The image forming apparatus according to claim 1, wherein the support member is electro conductive, and the electro conductive knit fabric is grounded via the support member or is capable of being applied with a voltage via the support member.

4. The image forming apparatus according to claim 1, wherein the metal fibers have a fiber diameter of 8 μm or more to 20 μm or less.

5. The image forming apparatus according to claim 1, wherein a discharge member side magnet is disposed inside the support member within the charge elimination nip width.

6. The image forming apparatus according to claim 5, wherein a magnetic pole of the discharge member side magnet on an outer side in a radial direction of the discharge member has a polarity different from a magnetic pole of the magnet member facing the magnetic pole.

7. The image forming apparatus according to claim 1, wherein the discharge member is rotatable in a direction opposite to the image carrier in a surface facing the image carrier, and linear speed ratio between the discharge member and the image carrier is changeable.

8. The image forming apparatus according to claim 1, wherein the discharge member is connected to a voltage applying device for applying a voltage having a polarity opposite to remaining charge on the surface of the image carrier.

9. The image forming apparatus according to claim 1, wherein the discharge member includes a first discharge member disposed on an upstream side in a rotation direction of the image carrier and a second discharge member disposed adjacent to and on a downstream side of the first discharge member.

10. The image forming apparatus according to claim 9, wherein the first discharge member is connected to a voltage applying device for applying a voltage having a polarity opposite to remaining charge on the surface of the image carrier, and the second discharge member is grounded.

11. An image forming apparatus comprising:

an image carrier having a surface on which a photosensitive layer is formed;

an electrifying member configured to electrify the photosensitive layer on the surface of the image carrier; and a charge eliminating device including a discharge member, the discharge member including:

an electro conductive knit fabric knitted in a cylindrical shape using twisted yarn made of twisted metal fibers; and a support member having a cylindrical shape, the support member being inserted in the electro conductive knit fabric, the discharge member being disposed to face the image carrier in a noncontact manner, in a state where the electro conductive knit fabric is grounded or a voltage is applied to the electro conductive knit fabric, the charge eliminating device generating a discharge between the discharge member and the image carrier so as to eliminate electric charge on the surface of the image carrier, wherein remaining charge on the surface of the image carrier is eliminated by the charge eliminating device, a magnet member is disposed inside the image carrier within a charge elimination nip width between two tangential lines of an outer circumference surface of the discharge member, the two tangential lines being parallel to a straight line passing through a rotation center of the image carrier and a center axis of the discharge member, the magnet member has two magnetic poles with maximum peaks, and the two magnetic poles are disposed within the charge elimination nip width, and the two magnetic poles of the magnet member are disposed in a radial direction radially from the rotation center of the image carrier, and a magnetic pole center angle between the two magnetic poles is 25 to 30 degrees.

12. The image forming apparatus according to claim 11, wherein the two magnetic poles of the magnet member have the same polarity.

13. An image forming apparatus comprising:

an image carrier having a surface on which a photosensitive layer is formed;

an electrifying member configured to electrify the photosensitive layer on the surface of the image carrier; and a charge eliminating device including a discharge member, the discharge member including:

an electro conductive knit fabric knitted in a cylindrical shape using twisted yarn made of twisted metal fibers; and a support member having a cylindrical shape, the support member being inserted in the electro conductive knit fabric, the discharge member being disposed to face the image carrier in a noncontact manner, in a state where the electro conductive knit fabric is grounded or a voltage is applied to the electro conductive knit fabric, the charge eliminating device generating a discharge between the discharge member and the image carrier so as to eliminate electric charge on the surface of the image carrier, wherein remaining charge on the surface of the image carrier is eliminated by the charge eliminating device, a magnet member is disposed inside the image carrier within a charge elimination nip width between two tangential lines of an outer circumference surface of the discharge member, the two tangential lines being parallel to a straight line passing through a rotation center of the image carrier and a center axis of the discharge member, and a plurality of magnet members having different magnetic forces are disposed inside the image carrier, and the magnet member disposed within the charge elimination nip width is switchable.

14. The image forming apparatus according to claim 13, wherein the magnet members include a first magnet member and a second magnet member having a smaller magnetic force than the first magnet member, and wherein a first position in which the first magnet member is positioned within the charge elimination nip width and a second position in which the second magnet member is positioned within the charge elimination nip width are switchable, and the magnet members are set to the second position when the accumulated number of printed sheets from the start of using the image carrier is less than a predetermined number, and the magnet members are switched to the first position when the accumulated number of printed sheets from the start of using the image carrier becomes the predetermined number or more.

15. The image forming apparatus according to claim 13, wherein the magnet members include a first magnet member and a second magnet member having a smaller magnetic force than the first magnet member, and wherein a first position in which the first magnet member is positioned within the charge elimination nip width and a second position in which the second magnet member is positioned within the charge elimination nip width are switchable, a full speed mode in which the image carrier is rotated at a predetermined speed for performing an image formation process and a deceleration mode in which the image carrier is rotated at a speed lower than the full speed mode for performing the image formation process are switchable, and the magnet member is set to the first position in the full speed mode, and the magnet member is switched to the second position in the deceleration mode.

16. The image forming apparatus according to claim 13, wherein the magnet members include a first magnet member and a second magnet member having a smaller magnetic force than the first magnet member, and wherein a first position in which the first magnet member is positioned within the charge elimination nip width and a second position in which the second magnet member is positioned within the charge elimination nip width are switchable, the electrifying member electrifies the image carrier more weakly than in an image formation process so that moisture on the surface of the image carrier can be removed as a refresh operation, and the magnet member is set to the first position when performing the refresh operation.

17. The image forming apparatus according to claim 13, wherein the magnet members include a first magnet member and a second magnet member having a smaller magnetic force than the first magnet member, and wherein a first position in which the first magnet member is positioned within the charge elimination nip width and a second position in which the second magnet member is positioned within the charge elimination nip width are switchable, and when an image formation process is not performed for a predetermined period of time or longer, both the first magnet member and the second magnet member are positioned outside the charge elimination nip width as a third position.

18. The image forming apparatus according to claim 11, wherein the two magnetic poles of the magnet member have different polarities.

* * * * *